US010479656B2

(12) United States Patent
Carmel

(10) Patent No.: US 10,479,656 B2
(45) Date of Patent: Nov. 19, 2019

(54) MODULAR, ADAPTABLE AND FOLDABLE APPARATUS FOR A CLIMBING CRANE

(71) Applicant: SKY-LINE CRANES & TECHNOLOGIES LTD., Barkan (IL)

(72) Inventor: Aviv Carmel, Hod Hasharon (IL)

(73) Assignee: SKY-LINE CRANES & TECHNOLOGIES LTD., Barkan (IL)

( * ) Notice: Subject to any disclaimer, the term of this patent is extended or adjusted under 35 U.S.C. 154(b) by 152 days.

(21) Appl. No.: 15/563,410

(22) PCT Filed: Mar. 30, 2016

(86) PCT No.: PCT/IL2016/050335

§ 371 (c)(1),
(2) Date: Sep. 29, 2017

(87) PCT Pub. No.: WO2016/157181

PCT Pub. Date: Oct. 6, 2016

(65) Prior Publication Data

US 2018/0086610 A1 Mar. 29, 2018

Related U.S. Application Data

(60) Provisional application No. 62/141,872, filed on Apr. 2, 2015.

(30) Foreign Application Priority Data

Apr. 1, 2015 (IL) ..... 238098

(51) Int. Cl.
*B66C 23/32* (2006.01)
*B66C 23/28* (2006.01)
(Continued)

(52) U.S. Cl.
CPC ..... *B66C 23/32* (2013.01); *B66C 23/28* (2013.01); *B66C 23/78* (2013.01); *B66C 23/00* (2013.01); *B66C 23/26* (2013.01)

(58) Field of Classification Search
CPC ..... B66C 23/32; B66C 23/28; B66C 23/26; B66C 23/16; B66C 23/00
See application file for complete search history.

(56) References Cited

U.S. PATENT DOCUMENTS 3,053,398 A 9/1962 Liebherr et al.
3,366,251 A 1/1968 Strand
(Continued)

FOREIGN PATENT DOCUMENTS

CN 203359856 12/2013
CN 103896165 7/2014

OTHER PUBLICATIONS

English-language International Search Report from Israeli Patent Office dated Jun. 30, 2016, in PCT/IL2016,050335.

*Primary Examiner* — Phi D A
(74) *Attorney, Agent, or Firm* — Finnegan, Henderson, Farabow, Garrett & Dunner LLP

(57) ABSTRACT

Crane-support apparatus for mounting a tower crane onto a side of a high-rise building under construction, enabling ascending of the tower crane according to the upwards progression of the building construction, including a chassis configured to support a climbing frame of the tower crane mast, and at least one reinforcement element. A distal end of the chassis is hingedly attached to the distal end of the reinforcement element. In a deployed, support mode, the chassis is aligned in a horizontal position, and the reinforcement element is aligned in a slanted position. In a folded, mobilization mode, the chassis and the reinforcement element are configured to be pulled by at least one lifting cable at the distal end of the chassis and the reinforcement element
(Continued)

with the chassis and the reinforcement element hingedly folded and aligned in vertical positions. A method for using the apparatus in both modes is also provided.

16 Claims, 8 Drawing Sheets

(51) Int. Cl.

| | |
|---|---|
| ***B66C 23/78*** | (2006.01) |
| *B66C 23/00* | (2006.01) |
| *B66C 23/26* | (2006.01) |

(56) References Cited

U.S. PATENT DOCUMENTS

| | | | | | |
|---|---|---|---|---|---|
| 3,485,384 | A | | 12/1969 | Sei Nikai et al. | |
| 3,591,123 | A | * | 7/1971 | Edwards | E04G 11/28 249/10 |
| 3,628,223 | A | * | 12/1971 | Babee | E04G 11/28 425/65 |
| 3,779,678 | A | * | 12/1973 | Scheller | E04G 11/22 425/65 |
| 4,029,173 | A | | 6/1977 | Wakabayashi | |
| 4,040,774 | A | * | 8/1977 | Scheller | E04G 11/28 425/65 |
| 4,255,120 | A | * | 3/1981 | Straitz, III | E21B 41/0071 169/69 |
| 5,065,838 | A | * | 11/1991 | Finley | E04G 3/34 182/142 |
| 5,630,482 | A | * | 5/1997 | Schw orer | E04G 11/28 182/141 |
| 5,645,395 | A | * | 7/1997 | Huang | B66C 19/00 212/199 |
| 6,478,172 | B2 | * | 11/2002 | Zingerman | B66C 23/22 212/179 |
| 6,557,817 | B2 | * | 5/2003 | Waldschmitt | E04G 11/28 182/36 |
| 7,290,672 | B2 | | 11/2007 | Davis et al. | |
| 7,513,480 | B2 | * | 4/2009 | Bergaretxe | E04G 11/28 249/20 |
| 8,708,100 | B2 | * | 4/2014 | Schwoerer | E04G 11/28 182/20 |
| 9,181,719 | B2 | * | 11/2015 | Jentsch | E04G 11/28 |
| 9,505,590 | B2 | * | 11/2016 | Chen | B66C 23/205 |
| 2003/0213765 | A1 | | 11/2003 | St-Germain | |

* cited by examiner

MODULAR, ADAPTABLE AND FOLDABLE APPARATUS FOR A CLIMBING CRANE

FIELD OF THE INVENTION

The present invention relates generally to construction and building structures, and specifically to tower cranes and lifting mechanisms.

BACKGROUND OF THE INVENTION

Construction is the process of forming buildings and structures. Cranes are used in construction to move and transport materials from one place to another. One type of crane is the tower crane. Tower cranes provide a good combination of height and lifting capacity needed in the construction of tall buildings. Tower cranes are used for lifting heavy building materials like concrete slabs, steel structures, bulk sand bags; machinery equipment like power generators, cement mixing machines; and other objects.

Tower cranes generally consist of the same basic parts: the base, the tower or mast, and the slewing unit. The base is typically bolted to a large concrete pad that supports the crane. The mast connects to the base and gives the crane its height. The slewing unit is attached to the top of the mast, and includes the gear and motor that allow the crane to rotate. On top of the slewing unit are three parts: the long horizontal jib or working arm, the shorter horizontal machinery arm, and the operator's cab. The long horizontal jib is the portion of the crane that carries the load. A trolley runs along the jib to move the load in and out from the crane's center. The shorter horizontal machinery arm contains the crane's motor that lifts the load, control electronics that drive the motor, large concrete counter weights, and the cable drum. The operator's cab is where the operator sits and controls the crane.

Tower cranes are typically located on top or near the top of buildings so that they can reach different parts of the building with ease to lift and drop materials and are very important for any new building built beyond a certain height. Tower cranes can be fixed to the ground on a concrete slab, or suspended off the ground and mounted to a structure. Tower cranes can use their own hoisting power to increase their height.

Three common methods of increasing the height of a tower crane are: the external climbing method, the internal climbing method, and the sky-crane method.

The external climbing method uses the crane's working arm or jib together with the crane's mast to expand the crane upward along the outside of the building. The base of the crane is fixed in a concrete slab in the ground, and the crane's mast is erected adjacent the building using smaller mobile cranes. Once the building reaches a certain height (typically about 180 feet or 15 stories), the crane is fastened to the building with steel collars, and new mast segments are inserted into the crane's existing mast. The crane has a special climbing section, in the form of a large metal sheath that scales the outside of the crane's mast, which is used to add new mast segments to the mast. The climbing section raises the crane's working arm above the last installed and stable mast segment and temporarily supports the working arm. A space in the climbing section is provided to take in a new mast segment, raised up by the crane's arm, and to hold the new mast segment temporarily while workers bolt the new mast segment into place. Using the external climbing method, the crane first constructs a section of the building, the crane is fastened to that section of the building, and then the crane receives new mast segments to grow taller.

The internal climbing method uses the crane to build new floors from the inside of the building. After a few new floors have been finished above the crane, the crane is advanced to a higher spot inside the building. When using the internal climbing method, the crane is typically positioned inside the center of the building, in a kind of makeshift courtyard, where the crane constructs the building (e.g., skyscraper) around itself. A hydraulic cylinder at the crane's base elevates the crane through the hollow core of the building to a higher floor. The hollow core is typically composed of a durable material such as concrete. Workers then slide steel beams underneath the crane to provide a sturdy new footing, and then the crane can continue to be used for construction tasks (i.e., building the next set of floors). Disadvantages of the internal climbing approach are the need to reinforce the building structure's outer walls to support very heavy loads, such as vertical loads of approximately 150 tons, and horizontal loads of approximately 40-50 tons, and that positioning the crane in the center of the construction can interfere with the construction process.

In the sky-crane method, the crane is airlifted by a heavy-lift helicopter and flown to the top of the building or construction site. Since a single segment of a crane's mast can typically weigh between 3,000 and 20,000 pounds, the lifting of the crane is done piece by piece. Due to the high monetary cost of performing such a task, and because flying a load-bearing helicopter over a populated area is logistically very difficult, the sky-crane method is quite rare.

CN Patent Application Publication No. 103896165(A) to Lixian et al entitled "Suspension Type Outside Climbing Tower Crane Supporting System and Turnover using Method thereof" discloses support brackets installed in the building unto which embedded parts allow the fixation of crane support frames which are supported in a horizontal crane supporting or hooping position, by upper and lower diagonal rods, also fixated to the brackets by the embedded parts. A lower frame can be dismantled and used as an upper frame as the tower crane is climbed. For dismantling of the support frame from the hooped crane, the support frame is halved into two sub-frames, allowing their separation from the hooped crane and their temporary hanging by ropes.

U.S. Pat. No. 4,029,173 to Wakabayashi entitled "Foldable Scaffold Devices", discloses an erectable and transportable gondola-like scaffold cage which includes a front frame member which is pivotally connected to a rear frame member and which may be folded into juxtaposition therewith for transportation or spaced outwardly therefrom to form a cage and which includes means for securing the entire element in position on a supporting structure such as a beam. A flexible member such as a chain, an extensible rod or a connecting plate, is connected between the upper ends of each side of the front structure to the upper ends of each side of the rear structure, and is pulled toward the rear to collapse the cage and the scaffold can be freely carried to another position as in a folded state and opened by loosening the flexible member.

U.S. Pat. No. 3,053,398 to Liebherr et al., entitled "Rotary Tower Crane", discloses a rotary tower crane where the tower is raised by adding tower sections.

U.S. Pat. No. 3,366,251 to Strand, entitled "Climbing Crane", discloses a climbing crane mounted to a rail, where the crane uses a hydraulic lift for elevating.

U.S. Pat. No. 3,485,384 to Nikai et al., entitled "Method of climbing a tower crane for constructing high buildings", discloses a tower crane having a bell portion that is slidable along the crane's mast.

U.S. Pat. No. 5,645,395 to Huang, entitled "Building crane apparatus climbable on building walls", discloses a gantry crane that climbs on rails secured to the building.

U.S. Pat. No. 7,290,672 to Davis et al., entitled "Tower Crane Device", discloses a tower crane device with a climbing frame.

US Patent Application Publication No. 2003/0213765 to St-Germain, entitled "Tower Crane with Raising Platform", discloses a self-erecting tower crane with tower sections and a self-raising sleeve.

SUMMARY OF THE INVENTION

In accordance with one aspect of the present invention, there is thus provided a crane-support apparatus for mounting a tower crane onto a side of a high-rise building under construction, enabling ascending of the tower crane according to the upwards progression of the building construction. The crane-support apparatus includes a chassis configured to support a climbing frame of the tower crane mast, and at least one reinforcement element. A distal end of the chassis is hingedly attached to the distal end of the reinforcement element. The apparatus also features at least one lifting cable for pulling the chassis and said reinforcement element. The crane-support apparatus is operational in a deployed, support mode, in which the chassis is aligned in a horizontal position, and is removably attachable at its proximal end to a first predetermined location of the building, such that the chassis is configured to support the climbing frame of the tower crane mast. And, in support mode the reinforcement element is aligned in a slanted position and is removably attachable at its proximal end to a second predetermined location of the building, such that the reinforcement element is configured to provide reinforcement to the chassis, thereby allowing securing of the tower crane mast to the building in support mode. The crane-support apparatus is also operational in a folded, mobilization mode, in which the chassis and the reinforcement element are configured to be pulled by the lifting cable at the distal end of the chassis and the reinforcement element with the chassis and the reinforcement element are hingedly folded and aligned in vertical positions when the chassis and the reinforcement element are unattached from the building, thereby allowing displacement, by the lifting cable, of the chassis and the reinforcement element when so folded in mobilization mode.

In accordance with another aspect of the present invention, there is thus provided a method of mounting a tower crane onto a side of a high-rise building under construction, enabling ascending of the tower crane according to the upwards progression of the building construction. The method uses a crane-support apparatus that includes a chassis that has a platform configured to support a climbing frame of the tower crane mast, at least one reinforcement element, and at least one lifting cable for pulling the chassis and the reinforcement element. A distal end of the chassis is hingedly attached to a distal end of the reinforcement element. The method includes the procedure of operating the crane-support apparatus in a deployed, support mode allowing securing of the tower crane mast to the building. The procedure of operating the crane-support apparatus in a support mode includes the sub-procedures of: aligning the chassis in a horizontal position and removably attaching the chassis at its proximal end to a first predetermined location of the building to support the climbing frame of the tower crane mast, aligning the reinforcement element in a slanted position and removably attaching the reinforcement element at its proximal end to a second predetermined location of the building to provide reinforcement to the chassis. The method further includes the procedure of operating the crane-support apparatus in a vertically folded, mobilization mode allowing displacement of the crane-support apparatus. The procedure of operating the crane-support apparatus in a mobilization mode includes the sub-procedures of: detaching the chassis and the reinforcement element from the building, and hanging and pulling, by the lifting cable, the chassis and the reinforcement element at the distal end of the chassis and the reinforcement element while allowing the chassis and the reinforcement element to hingedly fold and align in vertical positions.

BRIEF DESCRIPTION OF THE DRAWINGS

The present invention will be understood and appreciated more fully from the following detailed description taken in conjunction with the drawings in which.

DETAILED DESCRIPTION OF THE EMBODIMENTS

The present invention overcomes the disadvantages of the prior art by providing an apparatus for enabling a tower crane to mount onto different floors or heights of a building under construction, and ascend and descend between the different heights. The crane-support apparatus provides a relatively inexpensive and easy to use way of having a crane climb up or down a building, to increase or otherwise adjust the height or position of the crane relative to the height of the building or structure being built, enabling ascension of the tower crane according to the upwards progression of the building construction. The crane-support apparatus utilizes an easy to fold and collapse structure with adaptable connections to provide an assembly with high tolerance to deviations that is convenient to use. The crane-support apparatus is operational in a deployed, support mode for securing the tower crane mast to a building and a collapsed, vertically folded, mobilization mode which allows the displacement of the crane-support apparatus.

Figure 1A:
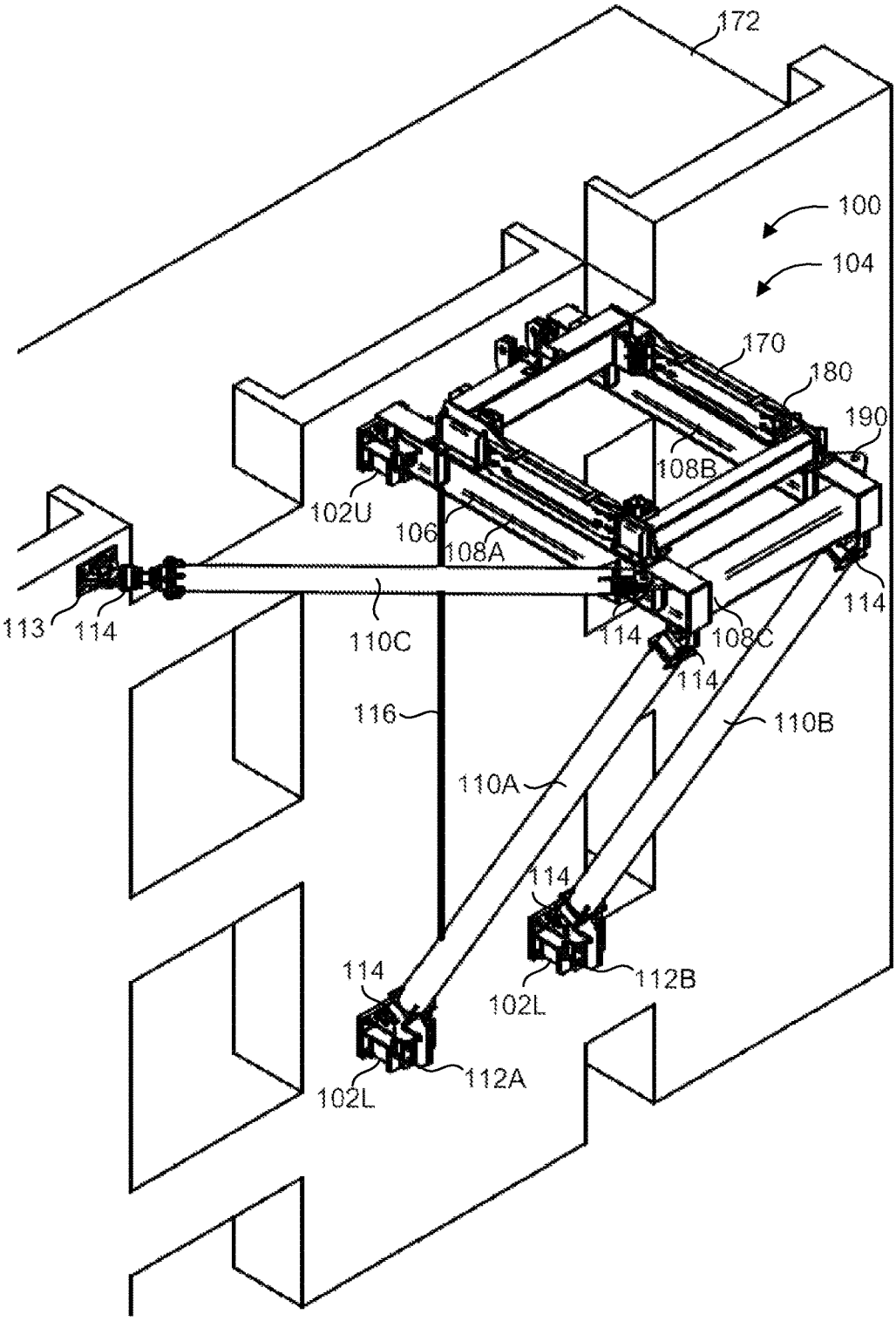
FIG. 1A is a schematic illustration of a crane-support apparatus for enabling a tower crane to mount onto different heights of a building under construction and ascend and descend there-between, in a support mode, constructed and operative in accordance with an embodiment of the present invention.
Figure 1B:
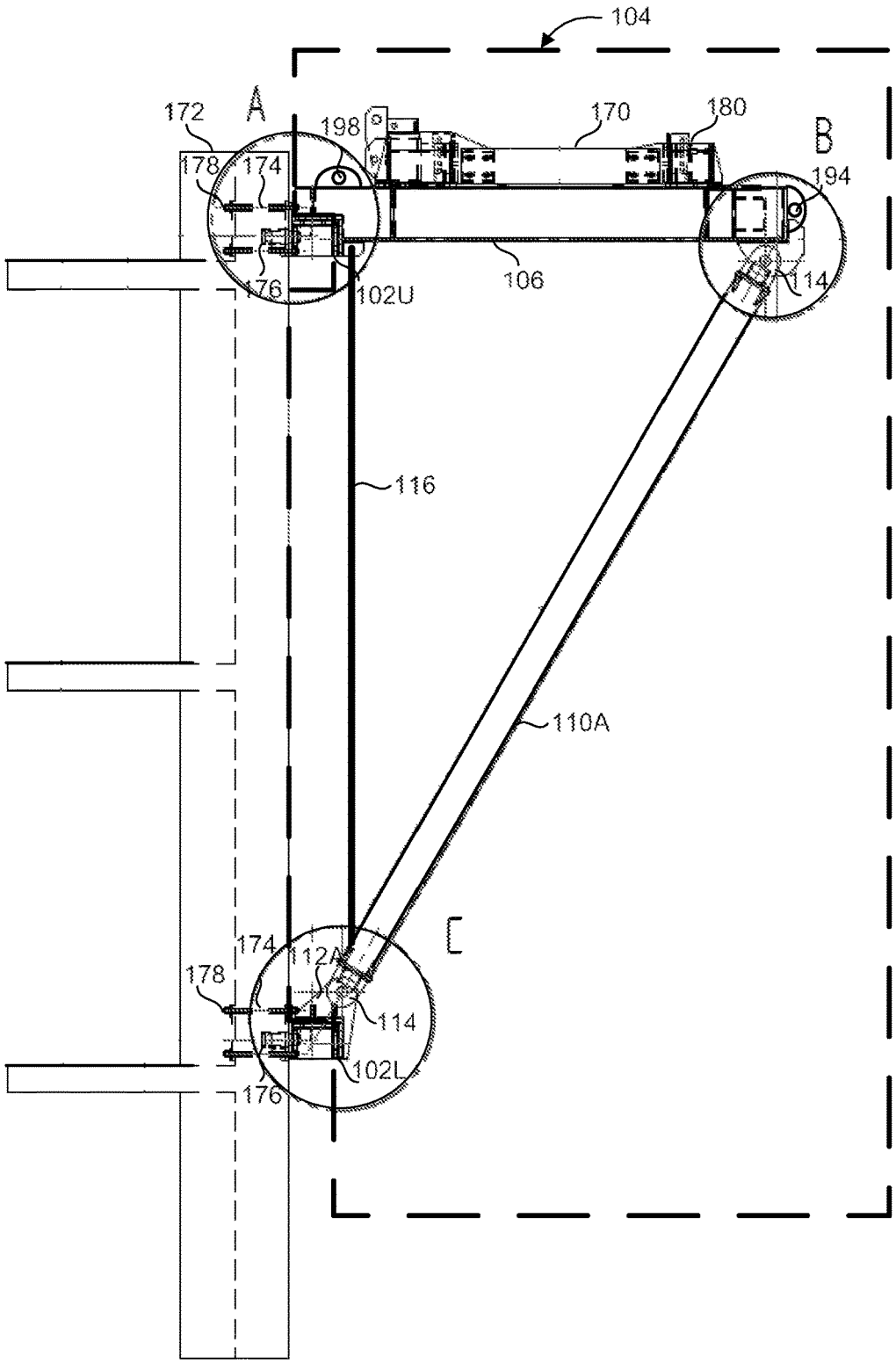
FIG. 1B is a side view illustration of the crane-support apparatus of FIG. 1A.
Figure 2:
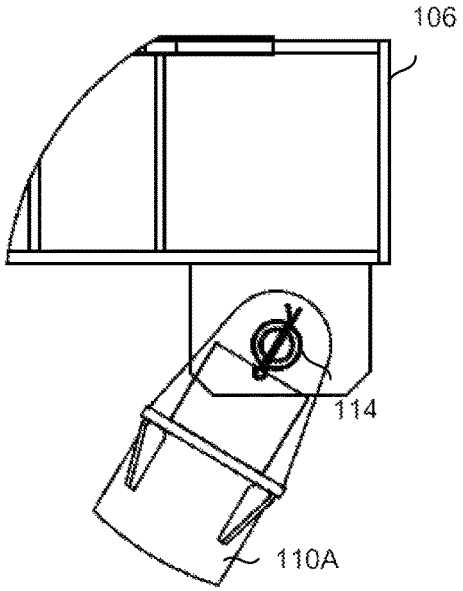
FIG. 2 is a zoomed in view illustration of section A of FIG. 1B, showing a flexible joint of the crane-support apparatus.
Figure 3:
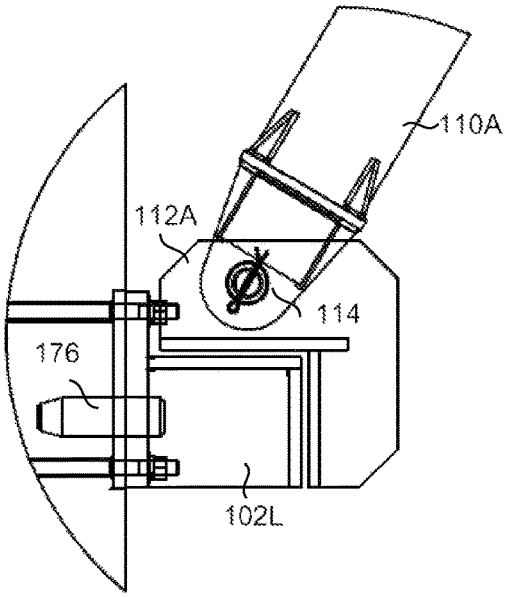
FIG. 3 is a zoomed in view illustration of section B of FIG. 1B, showing another flexible joint of the crane-support apparatus.
Figure 4:
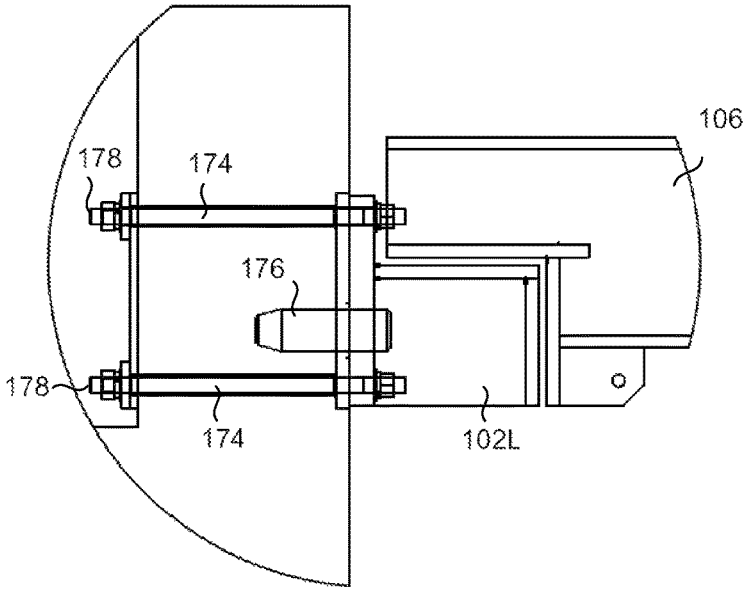
FIG. 4 is a zoomed in view illustration of section C of FIG. 1B, showing the implant elements inside the building structure.

Reference is now made to FIGS. 1A and 1B. FIGS. 1A and 1B are schematic perspective and side view illustrations, respectively, of a crane-support apparatus, generally referenced 100, for enabling a tower crane, referenced 170, to mount onto and to ascend or descend between different heights of a building structure, generally referenced 172, under construction, constructed and operative in accordance with an embodiment of the present invention.

Crane-support apparatus 100 includes four seat-shaped jut-anchors 102U, 102L and a support frame 104. Support frame 104 includes a U-shaped chassis 106, diagonally oriented reinforcement elements, illustrated as beams 110A, 110B, 110C, ear-shaped adapters 112A, 112B, a connector plate 113, flexible joints 114, and a cable 116. Chassis 106 is composed of two parallel arms 108A, 108B linked at one end with a third perpendicular arm 108C. The structure of the individual parts will be discussed further herein-below with reference to FIGS. 6 to 14B that show a detailed view of these components.

Figure 6:
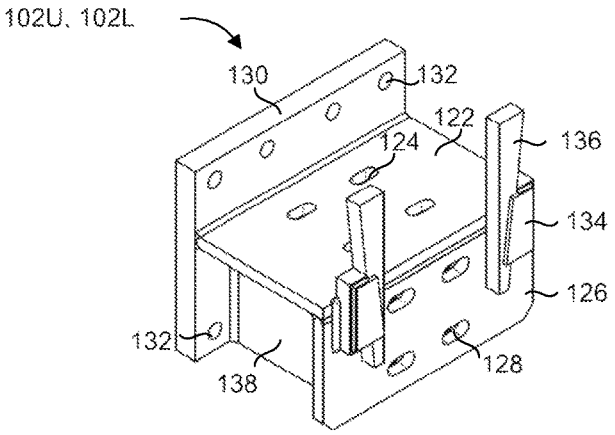
FIG. 6 is a perspective view illustration of the jut-anchor of the crane-support apparatus of FIG. 1A.
Figure 7:
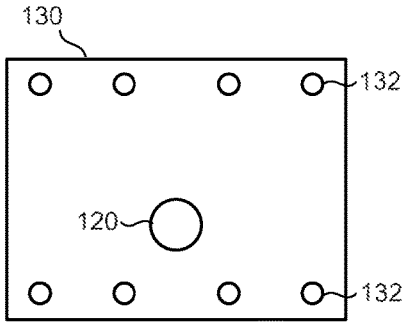
FIG. 7 is a front view illustration of the jut-anchor of FIG. 6.
Figure 8:
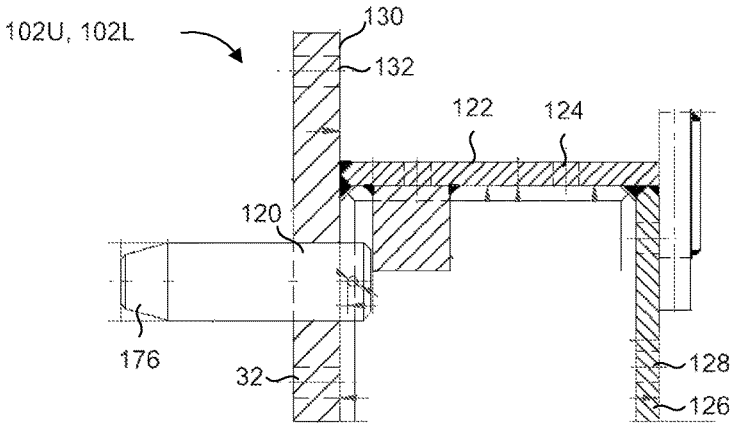
FIG. 8 is sectional side view illustration of the jut-anchor of FIG. 6.
Figure 9A:
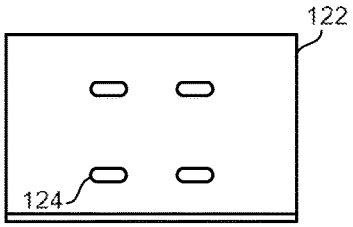
FIG. 9A is a schematic illustration of the upper horizontal surface plate of the jut-anchor of FIG. 6.
Figure 9B:
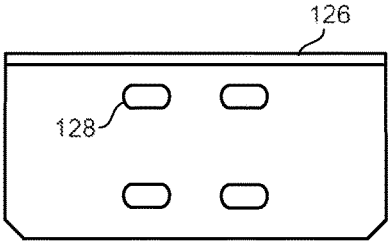
FIG. 9B is a schematic illustration of the lower vertical surface plate of the jut-anchor of FIG. 6.

Reference is now made to FIGS. 6 to 9B which are illustrations of a jut-anchor 102U, 102L according to one embodiment of the invention. FIGS. 6 to 8 are perspective, front and sectional side views, respectively, of jut-anchor 102U, 102L. FIGS. 9A and 9B are schematic illustrations of the upper horizontal surface plate and the lower vertical surface plate, respectively, of jut-anchor 102U, 102L. Jut-anchor 102U, 102L has an L-shaped structure (somewhat resembling a seat) that is complementary to the upside down L-shaped structure of a portion of chassis 106 and adapters 112A, 112B. Chassis 106 and adapters 112A, 112B are configured to rest on the surface of jut-anchors 102U, 102L. Jut-anchor 102U, 102L also includes apertures 120, 132 on a surface 130 thereof. Jut-anchor 102U, 102L is configured to connect to internal elements 174 (FIG. 1B) embedded in the wall of building structure 172 by insertion of a pin 176 and bolt 178 through apertures 120, 132. Apertures 120, 132 are formed in the flat back of chair portion plate 130 of jut-anchor 102U, 102L that is laid flush with and anchored to the surface of the building wall of building structure 172. Implant elements 174 are embedded within a concrete portion of building 172 at predetermined locations along the path of ascent of tower crane 170 and provide attachment means for attaching jut-anchors 102U, 102L. Jut-anchor 102U, 102L includes a horizontal ledge or indentation 122 for supporting or engaging with a corresponding flat horizontal surface of the chassis 106 or adapter 112A, 112B when laid flush on the jut-anchor 102U, 102L. Jut-anchor 102U, 102L also includes a vertical ledge 126 for supporting or engaging with a corresponding flat vertical surface of the chassis 106 or adapter 112A, 112B. Both ledges 122, 126 include apertures 124, 128 corresponding to the size and shape of apertures on chassis 106 and adapter 112A, 112B. Jut-anchor 102U, 102L may further include additional components aside from bolts, such as wedge holders 134 and wedges 136, for securing the connections to chassis 106 or adapter 112A, 112B, and/or aligning and maintaining different components in place.

Figure 10:
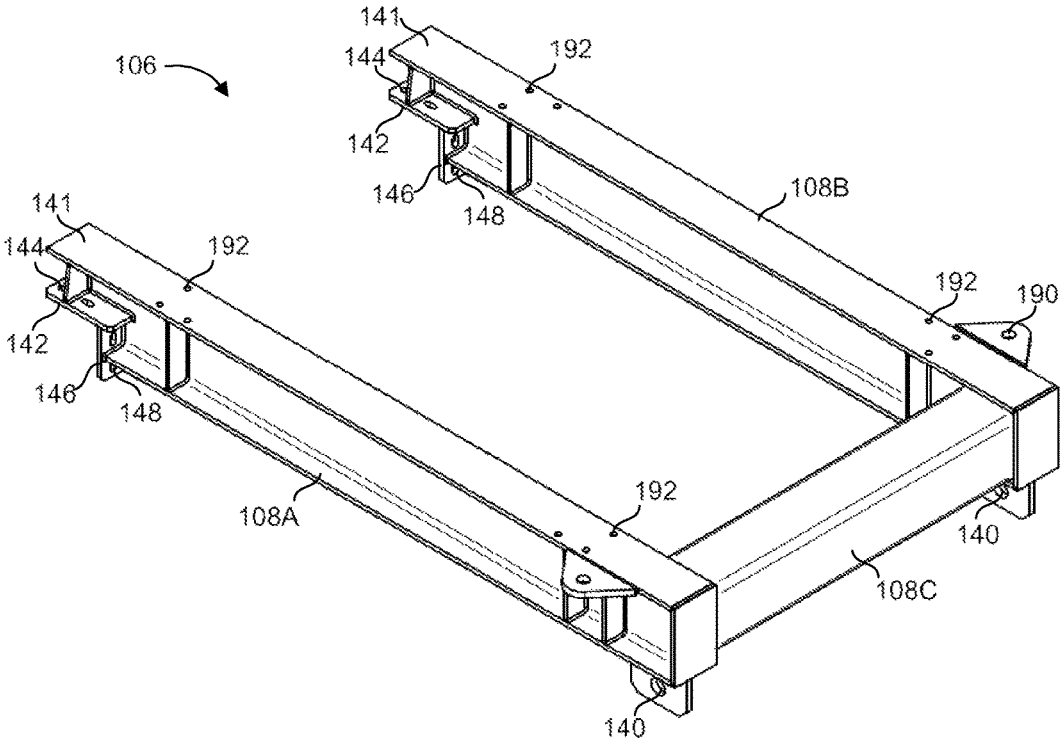
FIG. 10 is a perspective view illustration of the u-shaped support chassis of the crane-support apparatus of FIG. 1A.
Figure 11:
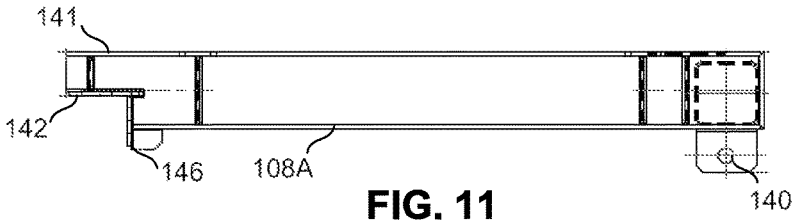
FIG. 11 is a side view illustration of the u-shaped support chassis of FIG. 10.
Figure 12A:
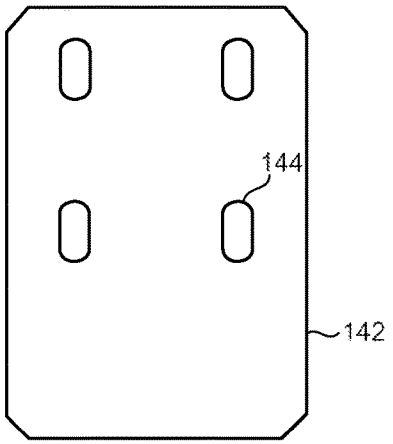
FIG. 12A is a schematic illustration of the upper horizontal surface plate of the u-shaped support chassis of FIG. 10.
Figure 12B:
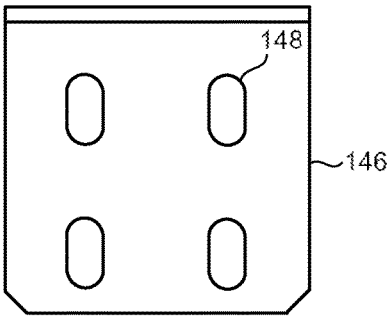
FIG. 12B is a schematic illustration of the lower vertical surface plate of the u-shaped support chassis of FIG. 10.
Figure 13:
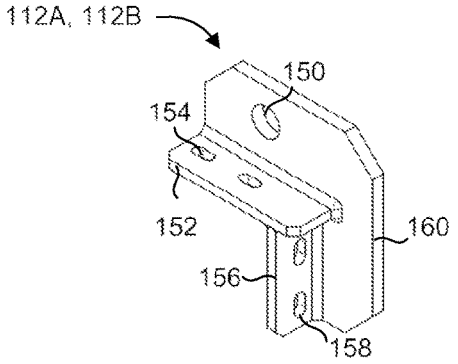
FIG. 13 is a perspective view illustration of the ear-shaped adapter of the crane-support apparatus of FIG. 1A.
Figure 14:
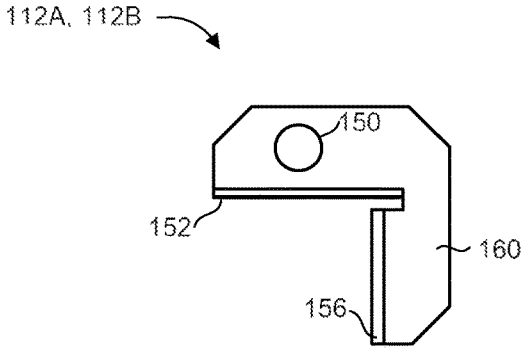
FIG. 14 is a side view illustration of the ear-shaped adapter of FIG. 13.
Figure 15A:
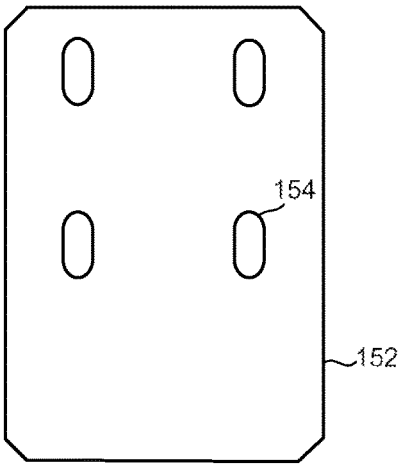
FIG. 15A is a schematic illustration of the upper horizontal surface plate of the ear-shaped adapter of FIG. 13.
Figure 15B:
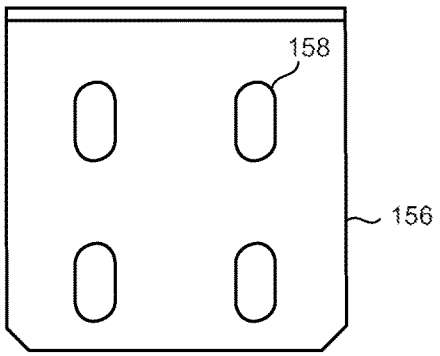
FIG. 15B is a schematic illustration of the lower vertical surface plate of the ear-shaped adapter of FIG. 13.

Reference is now made to FIGS. 10 to 12B which are illustrations of a U-shaped chassis 106 according to one embodiment of the invention. FIGS. 10 and 11 are perspective and side views, respectively, of U-shaped support chassis 106. FIGS. 12A and 12B are schematic illustrations of the upper horizontal surface plate and the lower vertical surface plate, respectively, of U-shaped support chassis 106. Chassis 106 provides a platform or base to support a climbing frame of the tower crane mast. Chassis 106 includes a left arm 108A and a right arm 108B aligned in parallel and joined at respective ends via an adjustable rear arm 108C, resulting in a "U-shaped" configuration. The length and position (i.e., distance of rear arm 108C from the peaks of the "U" of the U-shape or proximal end of chassis 106) of rear arm 108C can be adjustable so as to adapt to different sizes of lengths and/or widths of mast segments of tower cranes 170. Each side arm 108A, 108B on the distal end toward rear arm 108C includes a respective aperture 140, positioned at the respective arm corner adjacent to rear arm 108C. Aperture 140 is configured to engage with a beam 110A, 110B to hingedly attach a distal end of chassis 106 to a distal end of beam 110A, 110B, forming a flexible, bendable joint or connection 114 (FIGS. 1A, 1B). The opposite, proximal end of each side arm 108A, 108B (i.e., the other end away from aperture 140) is shaped and sized so as to engage with upper jut-anchor 102U. The proximal ends of chassis 106 (i.e., the peaks of the "U" of the U-shape) has an upside down L-shape forming an upside down L-shaped portion 141 with a horizontal ledge 142 for resting on or engaging with a corresponding flat horizontal surface 122 on upper jut-anchor 102U. Upside down L-shaped portion 141 of chassis 106 also has a vertical ledge 146 for resting on or engaging with a corresponding flat vertical surface 126 on upper jut-anchor 102U. Each ledge 142, 146 includes a respective aperture 144, 148, which is shaped and sized to substantially correspond to apertures 124, 128 of upper jut-anchor 102U. Chassis 106 further includes additional apertures 190 located on top ends of side arms 108A, 108B (adjacent to rear arm 108C), configured to attach chassis 106 to a side beam 110C. Additional apertures 194, 198 (FIG. 1B) are formed on the proximal and distal ends of chassis 106 to attach chassis 106 to lifting elements, such as a lifting cable or the hook of a winch arranged to lift support frame 104. Apertures 192 are provided in the proximal and distal ends of chassis 106 (e.g., on the top of arms 108A, 108B) to attach chassis 106 to a climbing frame 180 of tower crane 170. The mast of tower crane 170 can be slid along rails (not shown) in climbing frame 180. The mast of tower crane 170 can be locked into place and attached to climbing frame 180 using wedges or bolts.

Reference is now made to FIGS. 13 to 15B which are illustrations of an ear-shaped adapter 112A, 112B according to one embodiment of the invention. Each adapter 112A, 112B is characterized by an upside down L-shaped structure, resembling the proximal ends of chassis 106, as each adapter 112A, 112B is also configured to be situated on a respective jut-anchor 102. Each adapter 112A, 112B also includes a respective aperture 150 formed in an upper ridge portion 160 of adapter 112A, 112B. Aperture 150 is configured to hingedly connect adapter 112A, 112B to a proximal end of a respective beam 110A, 110B. Adapter 112A, 112B further includes a horizontal ledge 152 for resting on or engaging with a corresponding flat horizontal ledge 122 of lower jut-anchor 102L. Adapter 112A, 112B further includes a vertical ledge 156 for resting on or engaging with a corresponding flat vertical ledge 126 of lower jut-anchor 102L. Each ledge 152, 156 includes a respective aperture 154, 158, shaped and sized to substantially correspond to apertures 124, 128 of lower jut-anchor 102L. Adapter 112A, 112B may be composed of three separate segments: a horizontal plate, a vertical plate, and a rounded L-shaped plate. The horizontal and vertical plates are provided with apertures, for example, four apertures in each, for connection to jut-anchor 102. The rounded L-shaped plate segment may be formed with the aperture 150 for connecting to beam 110A, 110B.

Use of crane-support apparatus 100 will now be described with reference to FIGS. 1A to 5. As mentioned above, FIGS. 1A and 1B are schematic perspective and side view illustrations, respectively, of a crane-support apparatus 100, for enabling tower crane 170, to mount onto and to ascend or descend between different heights of building structure 172, in a deployed, support mode. Crane-support apparatus 100 is connected to implant elements 174 embedded within a concrete core portion of building structure 172 (see FIG. 1B and FIG. 4, a zoomed in view of section C of FIG. 1B). A pair of upper jut-anchors 102U and a pair of lower jut-anchors 102L are detachably connected to implant elements 174, such as via a pin 176 and bolts 178 to bolt jut-anchors 102U, 102L to predetermined locations on an outer wall of building structure 172 along the path of ascent or descent of tower crane 170 to provide a jutting protrusion or foothold for chassis 106 and beams 110A, 110B. Support frame 104 is mounted on building structure 172 by attaching support frame 104 to jut-anchors 102U, 102L with bolts thereby supporting, mounting, attaching, and connecting the crane 170 to the outside of the building 172. Chassis 106 is aligned in a horizontal position and is removably attached at its proximal end to jut-anchors 102U. Bolts (not shown) are used to attach climbing frame 180 of tower crane 170 to apertures 192 in chassis 106. Chassis 106 thereby provides a base or platform to support climbing frame 180. Mast segments of tower crane 170 are attached to climbing frame 180 using wedges or bolts. Bolts (not shown) are used to attach chassis 106 and adapters 112A, 112B to their corresponding jut-anchors 102U, 102L. Chassis 106 includes a left arm 108A and a right arm 108B. Each one of the arms (either right or left) 108A, 108B is hingedly attached at its distal end to a distal end of one of the pair of beams 110A, 110B (diagonally placed or oriented pipes or beams). Each one of the beams 110A, 110B is aligned in a slanted position and is also attached at its proximal end to an adapter 112A, 112B. Left beam 110A is attached to chassis 106 (left arm 108A) and left adapter 112A. Right beam 110B is attached to chassis 106 (right 108B) and right adapter 112B. Beams 110A, 110B thus connect chassis 106 to adapters 112A, 112B. Beams 110A, 110B and adapters 112A, 112B provide additional support and reinforcement to chassis 106 which holds tower crane 170. Beams 110A, 110B help support the vertical weight and forces of tower crane 170 thereby securing the tower crane mast to the building when the crane-support apparatus is in support mode.

Figure 5:
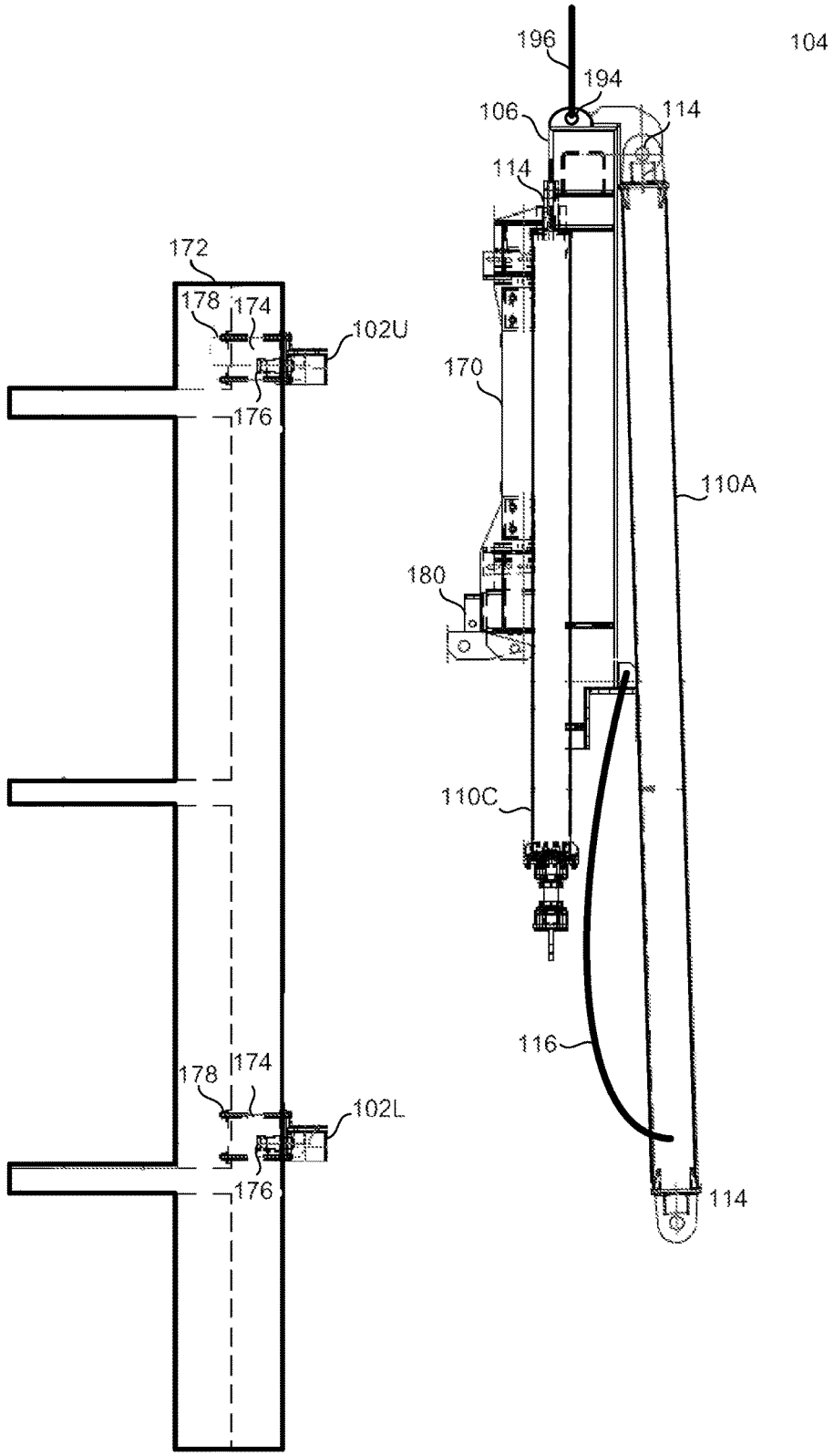
FIG. 5 is a side view illustration of the crane-support apparatus of FIG. 1A in a mobilization mode.

Each beam 110A, 110B is rotatably attached to (its side of) chassis 106 in a way that enables support frame 104 to be folded or collapsed (to be discussed further herein-below with reference to FIG. 5, a side view of crane-support apparatus 100 in a collapsed, vertically folded, mobilization mode of operation). The attachment or connection between a beam 110A, 110B and chassis 106 forms a foldable or flexible joint 114 (see FIG. 2, a zoomed in view of section A of FIG. 1A). The attachment or connection between a beam 110A, 110B and adapter 112A, 112B can also form a foldable or flexible joint 114 (see FIG. 3, a zoomed in view of section B of FIG. 1B). Rotatable attachment of a beam 110A, 110B to its corresponding adapter 112A, 112B enables the position or angle of adapter 112A, 112B relative to beam 110A, 110B to be adjusted. This may be especially useful when attaching support frame 104 to jut-anchors 102U, 102L, more specifically when attaching adapters 112A, 112B to lower jut-anchors 102L. A fixed-size cable 116 can be connected between each side arm 108A, 108B (left and right) of chassis 106 and its corresponding beam 110A, 110B for maintaining a specific position or angle (degree of inclination or slanted alignment) of the beam 110A, 110B relative to chassis 106. Cable 116 has a fixed length and is configured to maintain a specific distance or length between chassis 106 and adapter 112A, 112B, even after adjustment, movement or unfolding of support frame 104. In particular, cable 116 helps maintain a predetermined distance between the different parts when converting crane-support apparatus 100 from mobilization mode to support mode, which helps speed up attachment and reattachment of support frame 104. As mentioned above, a suitable mechanism can be used for lifting crane-support apparatus 100 from one location or height of the building structure 172 to another, such as, one or more winches (not shown). The winches may be attached to an opening within crane-support apparatus 100 for lifting support frame 104, for example a hook or lifting cable of the winch may be inserted through apertures 194, 198 at the distal and proximal ends, respectively, of arms 108A, 108B, 108C. Additional apertures (not shown), allowing insertion of a lifting cable or its hook, may be provided at the proximal ends of beams 110A, 110B or in adapters 112A, 112B to assist in the lifting and/or assembly of crane-support apparatus 100, such as by helping levelling beams 110A, 110B.

A horizontally aligned side beam 110C may optionally be hingedly attached at its distal end to aperture 190 (the distal end of chassis 106) and at its proximal end to an additional side connector plate 113. An adjustable length adapter (not shown) may be placed at the proximal end of horizontal side beam 110C to adjust the distance between horizontal side beam 110C and side connector plate 113. Horizontal side beam 110C assists in mitigating the torsion forces applied to crane 170 during turning or rotations. Side connector plate 113 may have a structure similar to jut-anchors 102U, 102L but may be oriented in a different manner (e.g., attached to the wall of building structure 172 in a direction or fashion that is perpendicular to the direction or fashion that jut-anchors 102U, 102L are attached to the wall of building structure 172.

Support frame 104 may be attached to jut-anchors 102U, 102L by inserting bolts (not shown) through respective apertures 124, 128, 144, 148, 154, 158 formed in jut-anchors 102U, 102L, chassis 106, and adapters 112A, 112B. Apertures 124, 128, 144, 148, 154, 158 can be substantially oval-shaped to facilitate the connection between chassis 106 or adapter 112A, 112B and its corresponding jut-anchor 102U, 102L. In particular, oval-shaped apertures 124, 128 of jut-anchors 102U, 102L can be formed in a first (e.g., X-axis) direction, and oval-shaped apertures 144, 148, 154, 158 of chassis 106 and adapters 112A, 112B can be formed in a second (e.g., Y-axis) direction perpendicular to the first (X-axis) direction of oval-shaped apertures 124, 128 of jut-anchors 102U, 102L. This configuration of oval-shaped apertures 124, 128, 144, 148, 154, 158 facilitates the connection of chassis 106 and adapters 112A, 112B to jut-anchors 102U, 102L because the area of overlap between the corresponding oval-shaped apertures 124, 128, 144, 148, 154, 158 provides a tolerance gap to compensate for deviation of the alignment between the connected parts (i.e., between chassis 106 or adapter 112A, 112B and jut-anchor 102U, 102L). This deviation can result from external forces (e.g., wind), or internal forces (e.g., deformation of the material or vertical misalignment along the building structure core). The aforementioned configuration of oval-shaped apertures 124, 128, 144, 148, 154, 158 further provides flexibility when connecting the components. For example, substantially round apertures may be difficult to correctly align or overlap directly with one other (e.g., due to movement or building deformations). The process of correctly aligning each individual pairs of apertures for all of the different connections may therefore be substantially time consuming. In contrast, oval-shaped apertures may be easier to align and allow for compensating for deviations in component alignment, which further serves to expedite the connection process since it allows adjustment of the connections to be made in all three dimensions.

Multiple crane-support apparatuses 100 of the present invention may be used to support a tower crane 170 to a vertical surface (i.e., a concrete core) of a building structure 172. Referring now to FIGS. 16A to 16D which are illustrations of a plurality of crane-support apparatuses 100A, 100B, 100C mounted to the side of building structure 172 at various heights. Each crane-support apparatus 100A, 100B, 100C is analogous to crane-support apparatus 100 described hereinabove. In this example, tower crane 170 is attached to and supported by at least two crane-support apparatuses at all times. When it is desired to transition crane 170 to climb or descend along the core of building structure 172, an additional crane-support apparatus 100 may be attached to support crane 170 before any one of the crane-support apparatuses currently in use are detached. For example, a third upper crane-support apparatus may be attached above the existing crane-support apparatuses on a newly completed building level before the bottom crane-support apparatus is detached. This crane-support arrangement provides a plurality of crane-support apparatuses mounted at predetermined positions along the path of ascending of the tower crane in a sequence (one above the other), where at least one crane-support apparatus remains in a support mode when another one the crane-support apparatuses is in a mobilization mode.

Figure 16D:
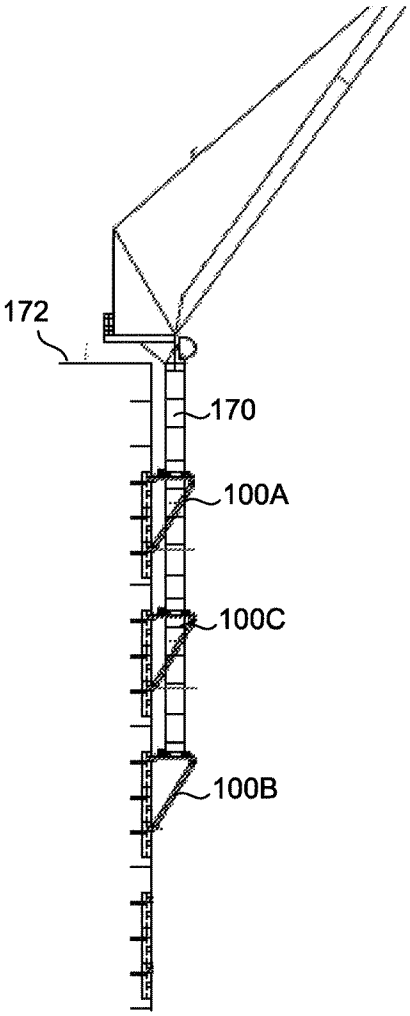
FIGS. 16A to 16D are schematic illustrations of a plurality of crane-support apparatuses mounted to the side of a building at various heights.
Figure 16C:
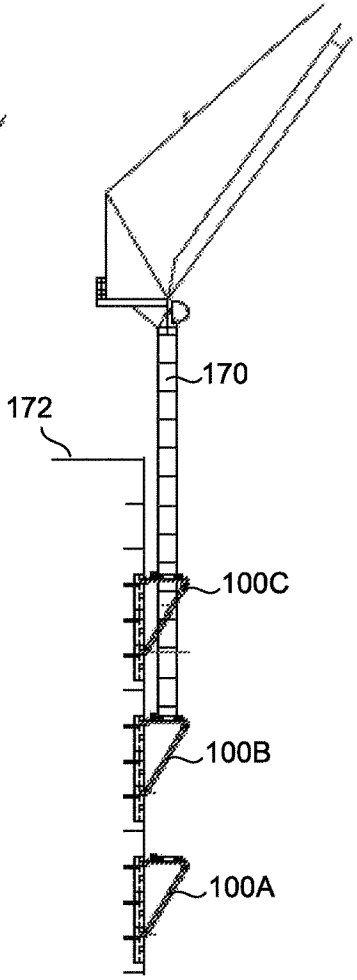
Figure 16B:
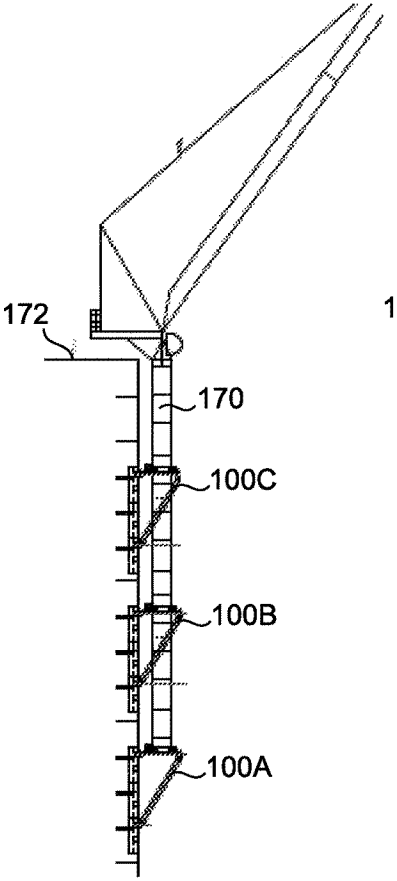
Figure 16A:
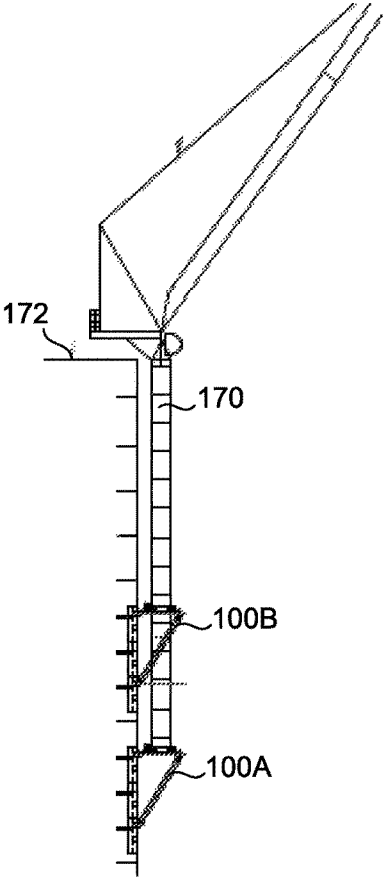

Reference is now made to FIG. 16A which shows tower crane 170 attached to the outside of building structure 172 by two crane-support apparatuses 100A and 100B in support mode. When it is desired to raise the height of tower crane 170 (e.g., when the height of building 172 has been raised or after a new level or floor has been completed) a third crane-support apparatus 100C can be attached to building 172 in support mode, as shown in FIG. 16B. The height of tower crane 170 can be raised to a new level (e.g., by raising tower crane 170 along rails inside climbing frame 180). The lifting of tower crane 170 separates tower crane 170 from the lowest crane-support apparatus 100A, as shown in FIG. 16C. The lowest crane-support apparatus 100A can now be detached from building 172 and converted into mobilization mode. In this case, tower crane 170 is always attached to building 172 by at least two crane-support apparatuses in support mode (e.g., 100A and 100B, or 100B and 100C).

When it is desired to raise tower crane 170 to a new height, crane-support apparatus 100A can be converted into mobilization mode, folded and raised to attach to building 172 in support mode, as shown in Figure 16D. Reference is now made to FIG. 5 which is a side view illustration of crane-support apparatus 100 in a mobilization mode. Flexible joints 114 allow the crane-support apparatuses 100A, 100B, 100C to be easily collapsed, transported and reassembled. In particular, crane-support apparatus 100 is collapsed by the suitable bending or collapsing of each flexible joint 114. The major components of crane-support apparatus 100 can be folded and hung or pulled by at least one lifting cable at the distal ends of chassis 106 and beams 110A, 110B with chassis 106 and beams 110A, 110B hingedly folded and aligned in vertical positions as crane-support apparatus 100 is lifted upwards by a lifting mechanism (such as a winch) of tower crane 170. Support frame 104 can be unbolted from jut-anchors 102U, 102L and the lifting mechanism, such as a lifting cable 196, attached to apertures 194 in chassis 106 pulls the hingedly folded chassis 106 and beams 110A, 110B, which are allowed to collapse into a vertical position while being pulled at their distal ends. The folding of the apparatus 100 can occur naturally (and may be assisted by gravity) as the lifting mechanism lifts the support frame 104 from jut-anchors 102U, 102L. Fixed size cable 116 can go slack when crane-support apparatus 100 is in mobilization mode. The crane itself helps raise the crane (crane-support apparatuses) to a higher level. The easy to fold and collapse modular adaptable crane-support apparatus 100 thus facilitates the process of raising tower crane 170 up along a building structure 172 during the construction process, and can be implemented substantially quickly. For example, the process of folding the crane-support apparatus 100 and raising crane-support apparatus 100 to a different height may be performed in approximately 10 hours as opposed to a similar process of 40 hours using conventional methods.

The folding feature is especially useful when support frame 104 needs to be moved from one place to another to increase the height of crane 170, or otherwise move crane 170 from one height of building structure 172 to another height of building structure 172. After support frame 104 is moved to the desired height, support frame 104 is converted from mobilization mode to support mode, i.e., unfolded and attached to a side of building 172. Lifting crane-support apparatus 100 by inserting a lifting cable or its hook at apertures 198 in proximal ends of chassis can assist moving chassis 106 from a vertical alignment to a horizontal alignment. Fixed-size cable 116 can assist moving beams 110A, 110B from a vertical alignment to a slanted alignment. As described above, in support mode chassis 106 is attached to upper jut-anchors 102U (left hand arm 108A attached to one upper jut-anchor 102U and right hand arm 108B attached to another upper jut-anchor 102U). Adapters 112A, 112B are attached to lower jut-anchors 102L (left adapter 112A attached to one lower jut-anchor 102L and right adapter 112B attached to another lower jut-anchor 102L).

When close to the bottom of building structure 172, tower crane 170 can be supported to a horizontal concrete base in the ground (not shown). When the height of tower crane 170 is increased so that the top of tower crane 170 is no longer close to the ground, tower crane 170 may alternatively be mounted exclusively to the building side of building structure 172 independent from the ground (e.g., hanging above the ground). It is appreciated that mounting or attaching tower crane 170 to the side of building 172, as opposed to placing or attaching crane 170 to a floor in the middle of building 170, may preclude the need to wait for the next floor to be completed before lifting crane 170 up to a higher level. As a result, the construction process is substantially expedited, as the next floor need not be fully completed before moving up the crane. Thus, the crane is able to work on higher levels sooner than would otherwise. The crane-support apparatus can be attached to the exterior of the concrete core (the interior of the concrete core being typically designated for elevator shafts) and does not need to wait for the exterior walls of the building to be completed before attachment.

Although in the above description adapters 112A, 112B are mounted to lower jut-anchors 102L and chassis 106 is mounted to upper jut-anchors 102U, alternatively support frame 104 can be mounted in the reverse fashion with adapters 112A, 112B mounted to upper jut-anchors 102U and chassis 106 mounted to lower jut-anchors 102L. Further alternatively, chassis 106 and adapters 112A, 112B can be L-shaped, and jut-anchors 102U, 102L can be upside down L-shaped. Reinforcement elements have been described as beams and chassis has been described as u-shaped, but alternatively other reinforcement elements capable of supporting the chassis and other configurations of a chassis that provides a support or base to the climbing frame, such as square metal plates, may be used. Also, the terms building or high-rise building refer to any appropriate or suitable structure that may benefit from having a tower crane climbing along it as its construction progresses upwards.

A method of mounting a tower crane onto a side of a high-rise building under construction, enabling ascending and descending of the tower crane according to the upwards or downwards progression of the building construction, using a crane-support apparatus as described above, is also provided. The method includes the procedures of operating a crane-support apparatus in a deployed, support mode allowing securing of the tower crane mast to the building, and operating the crane-support apparatus in a collapsed, vertically folded, mobilization mode allowing displacement of the crane-support apparatus. The procedure of operating a crane-support apparatus in a first, support mode includes the sub-procedures of: attaching jut-anchors to the building at a first predetermined location and a second predetermined location along the path of ascent or descent to provide a jutting protrusion or foothold for the crane-support apparatus, aligning the chassis in a horizontal position, removably attaching the chassis at its proximal end to a jut-anchor to support the climbing frame of the tower crane mast, aligning the reinforcement element in a slanted position and removably attaching the reinforcement element at its proximal end to a second jut-anchor to provide reinforcement to the chassis. The procedure of operating the crane-support apparatus in a vertically folded, mobilization mode includes the sub-procedures of: detaching the chassis and the reinforcement element from their corresponding jut-anchors, hanging and pulling, by a lifting cable, the chassis and the reinforcement element at the distal end of the chassis and the distal end of the reinforcement element while allowing the chassis and the reinforcement element to hingedly fold and align in vertical positions, and optionally detaching the jut-anchors from the building.

While certain embodiments of the disclosed subject matter have been described, so as to enable one of skill in the art to practice the present invention, the preceding description is intended to be exemplary only. It should not be used to limit the scope of the disclosed subject matter, which should be determined by reference to the following claims.

The invention claimed is:

1. A crane-support apparatus for mounting a tower crane onto a side of a high-rise building under construction, enabling ascending of the tower crane according to the upwards progression of the building construction, the crane-support apparatus comprising:

a chassis configured to support a climbing frame of the tower crane mast;

at least one reinforcement element, wherein a distal end of said chassis is hingedly attached to a distal end of said reinforcement element, and at least one lifting cable for pulling said chassis and said reinforcement element;

wherein said crane-support apparatus is operational in a deployed, support mode, in which said chassis is aligned in a horizontal position, and is removably attachable at its proximal end to a first predetermined location of said building, such that said chassis is configured to support the climbing frame of the tower crane mast, and in which said reinforcement element is aligned in a slanted position and is removably attachable at its proximal end to a second predetermined location of said building, such that said reinforcement element is configured to provide reinforcement to said chassis, thereby allowing securing of said tower crane mast to said building in said support mode, and wherein said crane-support apparatus is operational in a folded, mobilization mode, in which said chassis and said reinforcement element are configured to be pulled by said lifting cable at the distal end of said chassis and the distal end of said reinforcement element with said chassis and said reinforcement element are hingedly folded and aligned in vertical positions when said chassis and said reinforcement element are unattached from said building, thereby allowing displacement, by said lifting cable, of said chassis and said reinforcement element when so folded in said mobilization mode.

2. The crane-support apparatus as claimed in claim 1, further comprising jut-anchors detachably anchored to said building at said first predetermined location and said second predetermined location along the path of said ascent and configured to provide a jutting protrusions for said chassis and said reinforcement element when said crane-support apparatus is in said support mode.

3. The crane-support apparatus as claimed in claim 2, further comprising implant elements embedded within said building at said first predetermined location and said second predetermined location along the path of said ascent for providing attachment means for attaching said jut-anchors.

4. The crane-support apparatus as claimed in claim 1, wherein the connection between said chassis and said reinforcement element comprises a foldable joint for folding said crane-support apparatus when converting said crane-support apparatus from said support mode into said mobilization mode.

5. The crane-support apparatus as claimed in claim 1, further comprising a fixed-sized cable connecting between the proximal end of said reinforcement element and the proximal end of said chassis for maintaining the distance between the proximal end of said reinforcement element and the proximal end of said chassis when in said support mode.

6. The crane-support apparatus as claimed in claim 1, further comprising a lifting cable configured to pull the proximal end of said chassis when said crane-support apparatus is in said mobilization mode, for assisting horizontal alignment of said chassis required for conversion into said support mode.

7. The crane-support apparatus as claimed in claim 1, further comprising a lifting cable configured to pull the proximal end of said reinforcement element when said crane-support apparatus is in said mobilization mode, for assisting in the assembly of said reinforcement element for conversion into said support mode.

8. The crane-support apparatus as claimed in claim 2, further comprising an adapter mounted on the proximal end of said reinforcement element, to facilitate connection between said reinforcement element and said jut-anchors.

9. The crane-support apparatus as claimed in claim 8, further comprising oval-shaped apertures in at least one of:

said jut-anchors;

said chassis; and said adapter, said oval-shaped apertures configured to facilitate adjustment during assembly of said crane-support apparatus.

10. The crane-support apparatus as claimed in claim 1, further comprising a side reinforcement element attached between the distal end of said chassis and said building, said side reinforcement element configured to mitigate torsion forces of said tower crane.

11. The crane-support apparatus as claimed in claim 1, wherein said reinforcement element comprises a pair of beams.

12. The crane-support apparatus as claimed in claim 1, further comprising at least one aperture configured to attach a lifting mechanism for lifting said crane-support apparatus when said crane-support apparatus is in said mobilization mode.

13. A crane-support arrangement comprising a plurality of crane-support apparatuses as in claim 1, mounted at predetermined positions along the path of ascent of the tower crane in a sequence—one above the other, wherein at least one of said crane-support apparatus remains in said support mode when another one of said crane-support apparatuses is in said mobilization mode.

14. A method of mounting a tower crane onto a side of a high-rise building under construction, enabling ascending of the tower crane according to the upwards progression of the building construction, using a crane-support apparatus comprising a chassis configured to support a climbing frame of the tower crane mast, further comprising at least one reinforcement element, wherein a distal end of the chassis is hingedly attached to a distal end of the reinforcement element, and further comprising at least one lifting cable for pulling said chassis and said reinforcement element, the method comprising the procedures of:

operating said crane-support apparatus in a deployed, support mode allowing securing of said tower crane mast to said building, comprising the sub-procedures of:

aligning said chassis in a horizontal position and removably attaching said chassis at its proximal end to a first predetermined location of said building to support the climbing frame of the tower crane mast, and aligning said reinforcement element in a slanted position and removably attaching said reinforcement element at its proximal end to a second predetermined location of said building to provide reinforcement to said chassis; and operating said crane-support apparatus in a vertically folded, mobilization mode allowing displacement of said crane-support apparatus, comprising the sub-procedures of:

detaching said chassis and said reinforcement element from said building, and hanging and pulling, by said lifting cable, said chassis and said reinforcement element at the distal end of said chassis and the distal end of said reinforcement element while allowing said chassis and said reinforcement element to hingedly fold and align in vertical positions.

15. The method of mounting a tower crane as claimed in claim 14 wherein said procedure of operating said crane-support apparatus in a support mode further comprises the sub-procedure of attaching jut-anchors to said building at said first predetermined location and said second predetermined location along the path of said ascent to provide a jutting protrusion for said crane-support apparatus.

16. The method of mounting a tower crane as claimed in claim 15 wherein said procedure of operating said crane-support apparatus in a mobilization mode further comprises the sub-procedure of detaching said jut-anchors from said building.

* * * * *